United States Patent [19]

Crawford

[11] 4,026,757

[45] May 31, 1977

[54] TAPE DISPENSER AND APPLICATOR

[76] Inventor: Harry J. Crawford, 22955 Glenmoor Heights Drive, Farmington, Mich. 48024

[22] Filed: Mar. 15, 1976

[21] Appl. No.: 666,869

[52] U.S. Cl. ..... 156/575; 118/264; 156/577

[51] Int. Cl.[2] ..... B44C 7/00; B05C 11/00

[58] Field of Search ..... 156/575, 577; 118/264

[56] References Cited

UNITED STATES PATENTS

| | | | |
|---|---|---|---|
| 2,904,206 | 9/1959 | Bertschnger | 156/577 |
| 3,586,587 | 6/1971 | Boyce | 156/577 |
| 3,666,601 | 5/1972 | Wuerch | 156/577 |

*Primary Examiner*—Douglas J. Drummond
*Attorney, Agent, or Firm*—Robert G. Mentag

[57] ABSTRACT

A tape dispenser for applying electrically conductive adhesive tape or foil on a flat surface. When applied on a flat surface, the tape forms a part of an electrical alarm system. The dispenser includes a housing having a tape storage chamber in which is rotatably mounted a roll of tape. The housing has an extension on the front side thereof through which the tape is dispensed. A pressure member is mounted on the housing extension over the point at which the tape is discharged from the housing extension for use in pressing the tape on a flat surface as it is discharged from the dispenser. The housing is provided with a guide means for guiding the dispenser in a straight line. The guide means is used for engagement with a window frame for guiding the dispenser as it moves over the window pane. The tape dispenser can also be used for making a right angle turn when applying tape to a flat surface.

7 Claims, 13 Drawing Figures

FIG. 3
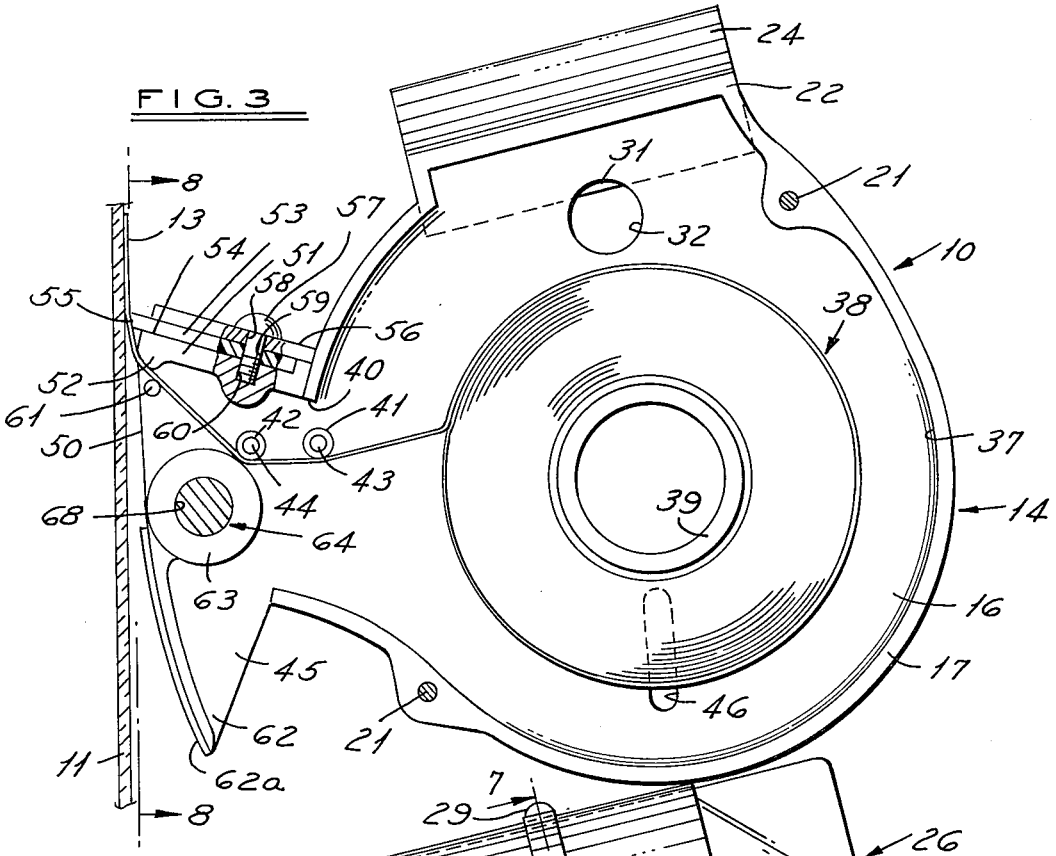
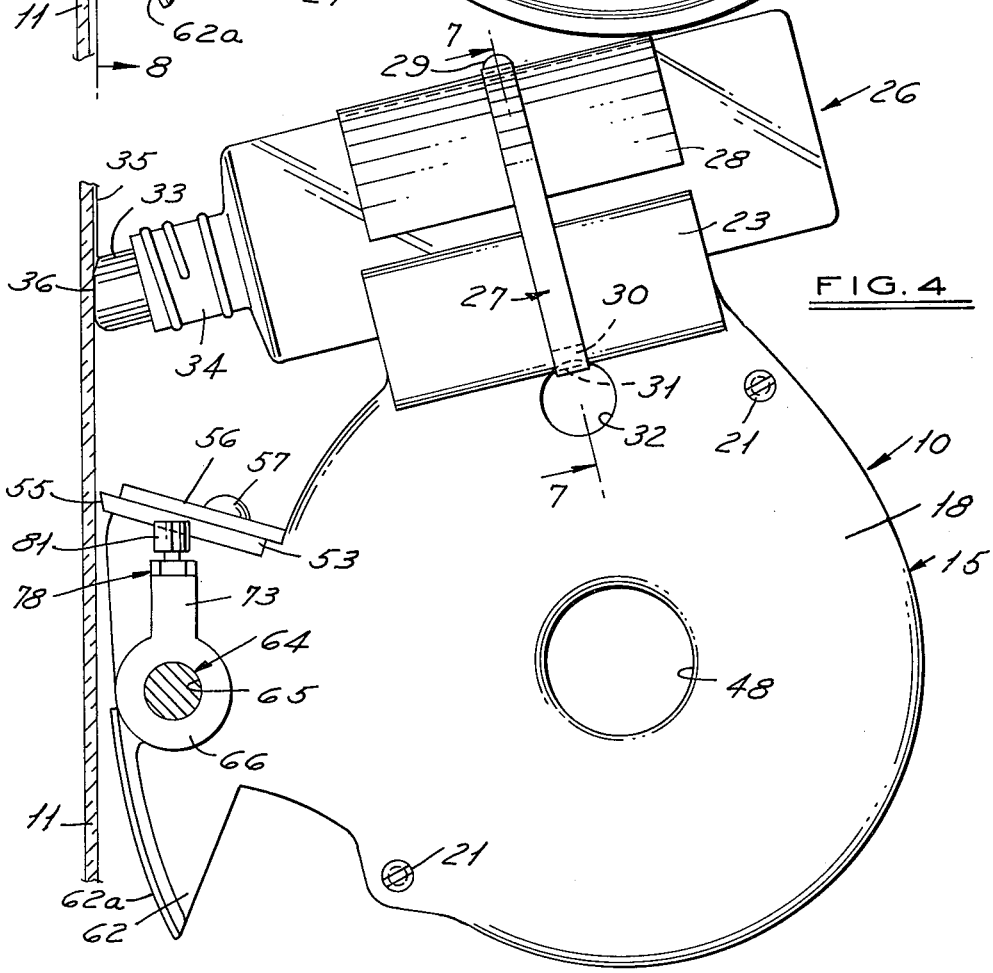
FIG. 4

TAPE DISPENSER AND APPLICATOR

SUMMARY OF THE INVENTION

This invention realtes generally to adhesive tape dispensers, and more praticularly, to a tape dispenser particularly adapted for use in applying electrical conductive adhesive tape on a window pane, door pane and the like, for use as a part of an electrical alarm circuit.

Heretofore, the application of electrically conductive adhesive tape or foil windows and other flat surfaces has been made manually. In accordance with the prior art mehtods of manually applying tape on a flat surface, the installer uses rolled adhesive tape which has a paper liner. The installer must first lay out lines on the window in accordance with the path which the tape is to follow over the window before he can apply the tape. Such procedure is time consuming. After making the layout of the path which the tape is to follow, in accordance with the prior art manual method, the installer then hangs up a length of unrolled tape on a hook in the ceiling or somewhere near the window, and then the lining paper is peeled off of the tape and the installer then manually applies the tape along the lines previously drawn on the window, without stretching or breaking the tape. If the window is moist and cold, then the installer must first apply a varnish or other adhesive on the window to hold the tape on the window regardless of the fact that the tape itself is provided with an adhesive backing. In accordance with the prior art manual method of applying the tape, it is also difficult to make a right angle turn when applying tape to a window. In view of the foregoing, it is an important object of the present invention to provide a novel and improved tape dispenser for applying electrically conductive adhesive tape or foil to a window pane or the flat surface, and which overcomes the aforementioned disadvantages of the prior art manual method or applying such tape to a window or other surface.

It is another object of the present invention to provide a novel and improved tape dispenser which is simple and compact in construction, economical to manufacture, efficient in operation, and applies tape in a minimum of time.

It is a further object of the present invention to provide a novel and improved tape dispenser for applying electrically conductive adhesive tape or foil on a window pane, and which is provided with guide means for guiding the dispenser in straight lines over the window pane.

It is still another object of the present invention to provide a novel and improved tape dispenser for applying electrically conductive adhesive tape or foil to a window pane, and which is also provided with varnish applying means for applying a strip of varnish to a window pane before the tape is applied for use in adhering the tape to the window pane, and which may be used for applying a second costing of varnish to the window pane, so as to cover the tape and make it moisture-proof.

It is a futher object of the present invention to provide a novel and improved tape dispenser for applying tape on a flat surface, and which includes a housing in which is rotatably mounted a roll of tape, a pressure means operatively mounted on the housing at a position for applying pressure on the tape as it is discharged from the housing, and a guide means adjustably mounted on the housing for guiding the dispenser along a predetermined path.

Other features and advantages of the invention will be apparent from the following detailed description, appended claims, and the accompanying drawings.

BRIEF DESCRIPTION OF THE DRAWINGS

FIG. 3 is an elevation section view of the tape dispenser structure illustrated in FIG. 1, taken along the line 3—3 thereof, and looking in the direction of the arrows.

FIG. 4 is an elevation view, partly in section, of the structure illustrated in FIG. 1, taken along the line 4—4 thereof, and looking in the direction of the arrows, and showing the varnish applicator in an operative position.

DETAILED DESCRIPTION OF THE PREFERRED EMBODIMENT OF THE INVENTION

Figure 1:
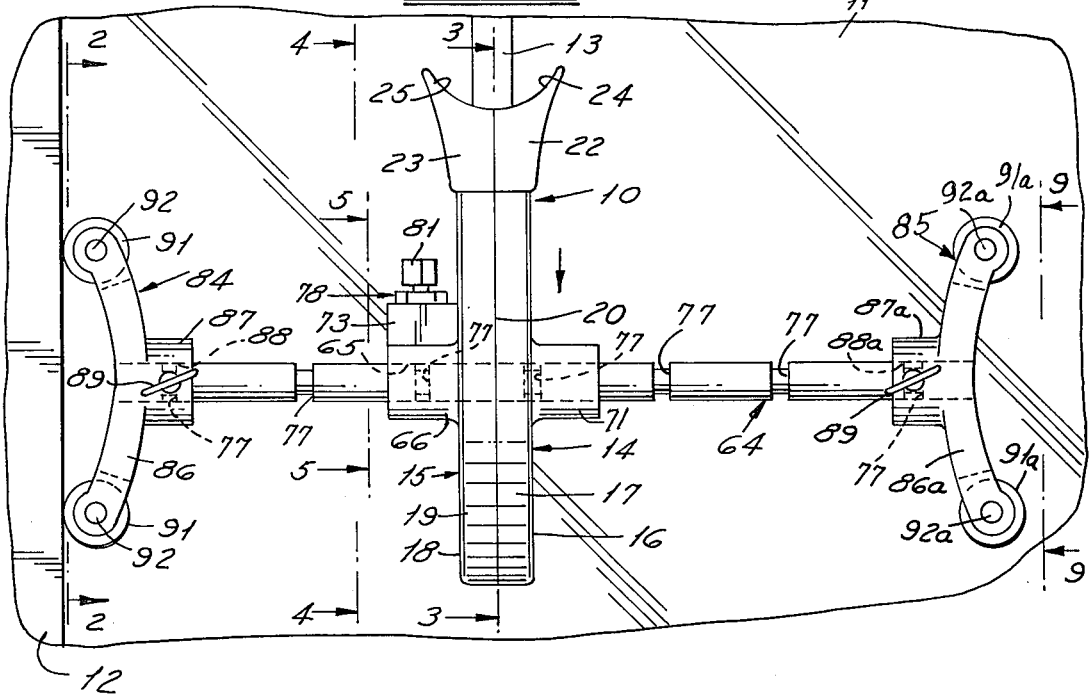
FIG. 1 is an elevation view of an illustrative embodiment tape dispenser of the present invention, and showing it in position on the surface of a window.
Figure 2:
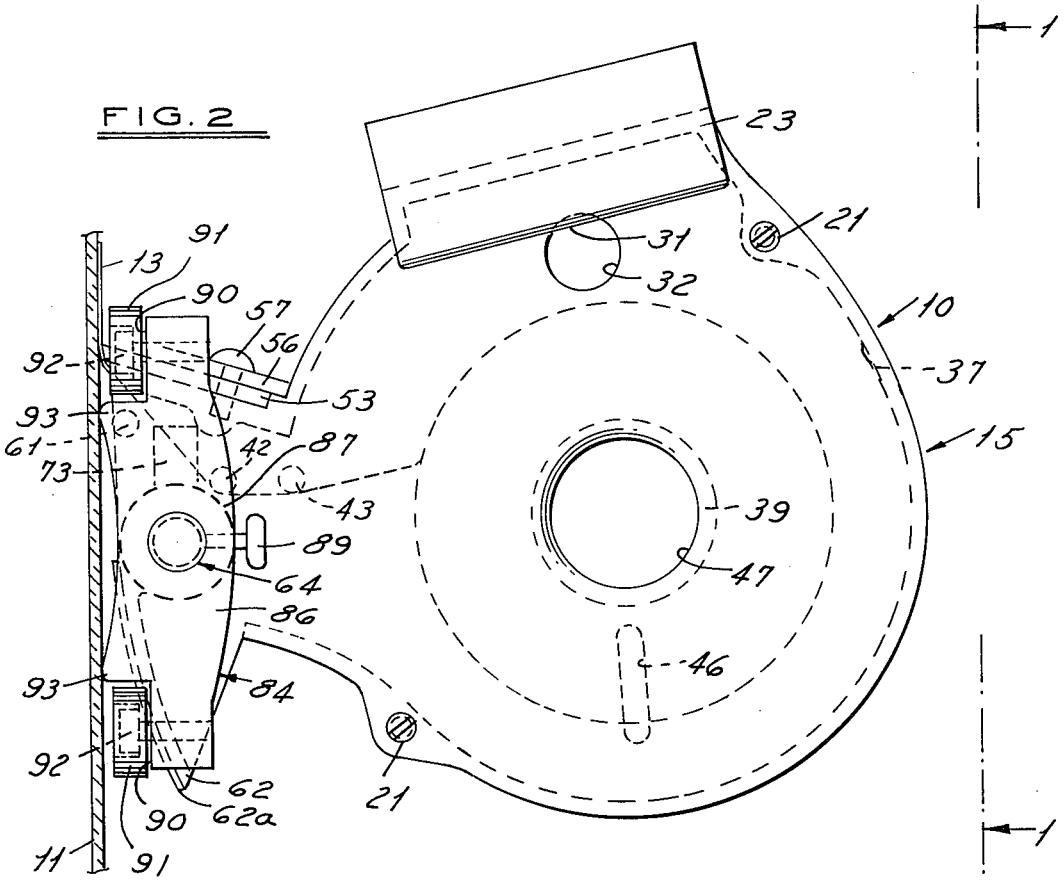
FIG. 2 is a left side view of the tape dispenser structure illustrated in FIG. 1, taken along the line 2—2 thereof, and looking in the direction of the arrows.

Referring now to the drawings, and in particular to FIGS. 1 and 2, the numeral 10 generally designates a tape dispenser made in accordance with the principles of the present invention, and showing the tape dispenser operatively mounted on a window pane 11. The numeral 12 designates a side frame of the window on which the tape dispenser 10 is operating.

In FIG. 1, the tape dispenser 10 is shown in a tape aplying position wherein the tape dispenser 10 is being moved downward vertically, in the direction of the arrow, and is applying a strip of electrically conductive adhesive tape or foil, indicated by the numeral 13. The tape 13 may be any suitable electrical conductive tape used as a part of an electrical alarm system, such as a flexible lead-tin or lead-zinc compound tape. The tape 13 includes an adhesive backing which is adapted to provide a firm connection to the surface of the window pane 11. The foil is usually about ⅜ in. wide and 0.002 thick, although it can be slightly thinner or thicker.

As shown in FIG. 1, the tape dispenser 10 is provided with a casing or body that includes a right hand portion 14 and a left hand portion 15. As shown in FIGS. 3 and 4, the right and left hand body portions 14 and 15 respectively, are substantially circular in plan view. The right hand body portion 14 includes a substantially circular side wall 16 and an integral peripheral wall 17. The left hand housing portion 15 includes a substantially circular side wall 18 (FIG. 4) and an integral peripheral wall 19. As shown in FIG. 1, the housing peripheral end walls 17 and 19 are seated against each other along a joint line 20. The housing portions 14 and 15 are secured together by any suitable means, as by a pair of suitable machine screws 21.

Figure 7:
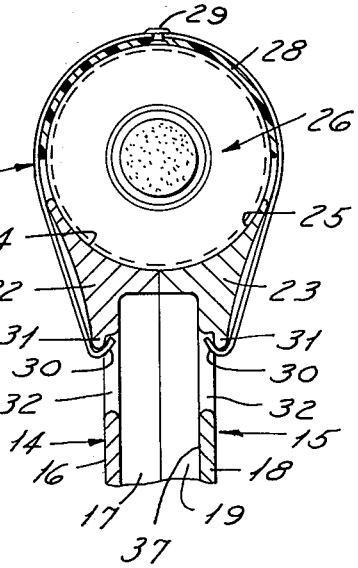
FIG. 7 is a fragmentary, elevation section view of the varnish applicator structure illustrated in FIG. 4, taken along the line 7—7 thereof, and looking in the direction of the arrows.

As best seen in FIGS. 1 and 7, each of the housing portions 14 and 15 is provided on the upper end thereof with an integral bottle holder 22 and 23 respectively, each of which is provided on the upper side thereof with a longitudinally extended concave bottle seat 24 ad 25, respectively. As shown in FIGS. 4 and 7, a bottle 26 for holding a sealant material, such as varnish or the like, is adapted to be seated in the bottle seats 24 and 25. The bottle 26 may be made from any suitable material, such as polyvinyl chloride. The bottle 26 is retained in place on the bottle seats 24 and 25 by a suitable flat spring retainer clip, generally indicated by the numeral 27. As shown in FIG. 7, the flat spring retainer clip 27 is provided with a half round retainer pad 28 which is made from any suitable flexible material, such as a plastic material. The retainer pad 28 is secured to the flat spring retainer clip 27 by any suitable means, such as by a rivet 29. The ends of the flat spring retainer clip 27 are formed as hooks 30, as shown in FIG. 7. The hooks 30 are each adapted to be snapped in place over a retainer lip 31 formed on the upper edge of a hole 32 formed in each of the housing portions 14 and 15.

As shown in FIG. 4, a dauber 33 is mounted in the neck 34 of the bottle 26 for applying a strip of varnish 35 to the window pane 11, as desired. The dauber 33 may be made from any suitable material, as for example, a foam plastic material. The varnish may be applied in strips 35 on the window pane 11 by bringing a slight pressure to bear on the flexible plastic bottle 26 as the dispenser 10 is moved over the window pane 11 in a desired course, or path. The dauber 33 is preferably formed with a rectangular outer edge 36, whereby it may be turned by rotating the bottle in one direction to apply the smaller dimension to provide a strip of varnish equal to the width of the tape 13 to be applied on the pane 11, and then later turned so that the larger dimension of the dauber is applied against the pane 11 so as to provide a wider strip of varnish 35 to cover the tape 13 held on the window pane 11 by the first narrow strip of varnish. It will be understood that the first narrow strip of varnish is used in instances where the window pane 11 on which the tape 13 is to be applied is cold or damp. In such cases the window pane 11 is first wiped off along the path over which the tape 13 is to be applied, and then a first narrow strip of the varnish 35 is applied to the window pane 11 for purposes of adhering the tape to the window pane 11. A second wider coat of varnish 35 is applied over the strip of tape 13 and it functions to keep moisture from getting underneath the tape 13 and to discourage persons from picking at the tape so as to break the tape and short-circuit the alarm circuit.

As shown in FIG. 3, the housing portions 14 and 15 form a substantially cylindrical tape storage chamber 37 in which is rotatably mounted a roll of the conductive tape 13, and which roll is generally indicated by the numeral 38. The roll of tape 38 is rotatably mounted on a cylindrical hub or short shaft 39 which is integrally formed on the inner side of the housing portion 14 side wall 16. As best seen in FIG. 4, an opening 40 is formed through te peripheral housing side walls 17 and 19. The tape 13 is fed out through the opening 40 and over a pair of guide rollers 41 and 42 which are rotatably mounted on shafts 43 and 44, respectively. The shaft 43 is secured to the side wall 16 of the housing 14. The shaft 44 is secured to an outwardly extended wall extended wall extension 45 which is integral with the housing side wall 16. The housing side wall 16 is provided with an elongated radially extended slot 46 which functions as a sight hole to show an operator the amount of tape on the roll of tape 38. The numeral 47 (FIG. 2) comprises a finger hole which extends through the cylindrical tape supporting shaft 39 on the housing wall 16, and which mates with a similar finger hole 48(FIG. 4) formed through the side wall 18 of the housing porion 15.

Figure 8:
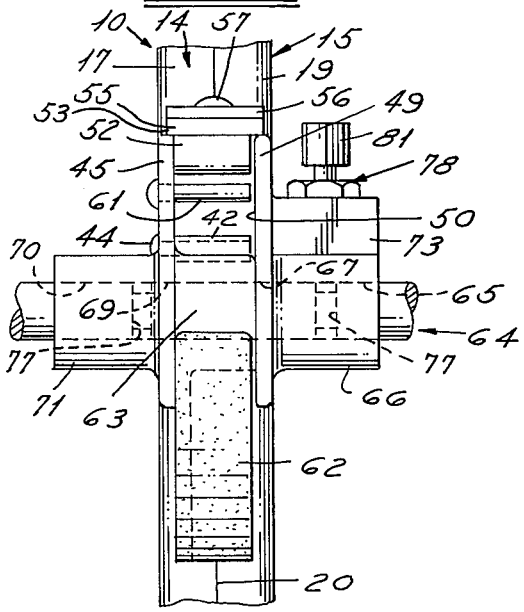
FIG. 8 is a front elevation view of the tape dispenser illustrated in FIG. 2, taken along the line 8—8 thereof, and looking in the direction of the arrows.

As shown in FIG. 8, the housing portion 15 is also provide with a forwardly projecting integral wall extension 49 which has its upper outer end spaced apart laterally from the other housing projecting wall 45 so as to provide an opening 50 through which the tape 13 emerges from the dispenser 10 for application to a window pane 11. The upper side of the opening 50 is enclosed by a wall portion 51 which is extended outwardly from the circular housing wall 17 and formed integral therewith. A rounded cylindrical tape guide 52 is integrally formed on the lower side of the wall 51, adjacent the front end thereof, for guiding the tape 13 as it emerges from the opening 50. A pressure pad 53 is mounted on the upper face 54 of the wall portion 51 and it has a tapered outer end face 55 which bears against the adjacent face of the tape 13 and functions as a means for exerting pressure to the tape 13 to apply it to the window pane 11 as the dispenser 10 is moved over the window pane 11. The pressure member or pad 53 is releasably secured to the wall 51 by a suitable retainer plate 56 and a machine screw 57. The screw 57 is extended through a hole 58 formed through the releasable retainer plate 56 and through an elongated slot 59 formed through the rear end of the pressure pad 53. The lower end of the screw 57 is threadably mounted in a threaded hole 60 formed in the wall portion 51. The elongated slot 59 extends to the rear end of the pressure pad 55 and it is open at that point, so that it is merely necessary to loosen the screw 57 to permit the pressure pad 53 to be slid outwardly and removed for replacement or cleaning purposes. As shown in FIGS. 3 and 8, a stationary guide pin 61 is fixedly mounted in the housing projecting wall 45, and it extends toward the housing projecting wall 49, whereby the tape 13 passes from the guide roller 42 and through the space between the two fixed guide members 52 and 61.

The housing projecting wall 45 has formed on the lower front edge thereof an arcuate guide flange 62 which extends between the housing projecting walls 45 and 49 and encloses the lower end of the opening between said walls, and which has a foam plastic pad 62*a* on the front side thereof. A cylindrical spacer member 63 is integrally formed on the inner face of the housing projecting wall 45, and its free end abuts the inner side of the housing projecting wall 49, as shown in fIG. 8.

The tape dispenser 10 is provided with guide means which include an elongated cylindrical shaft 64 which is slidably mounted through a bore 65 formed in a hub 66 (FIG. 8) which is integrally formed on the outer side of the housing projecting wall 49. As shown in FIG. 8, the cylindrical guide shaft 64 extends inwardly through a bore 67 formed through the housing projecting wall 49 and thence through a bore 68 formed through the spacer member 63. The guide shaft 64 then extends through a bore 69 formed through the housing projecting wall 45 and thence through a bore 70 formed through an integral hub 71 that is formed on the outer side of the housing projecting wall 45. The guide shaft 64 is slidably mounted in the continuous opening formed by the bores 65, 67, 68, 69, and 70, and it is held in a desired adjusted position by a spring-biased plunger 72, as shown in FIG. 6.

Figure 6:
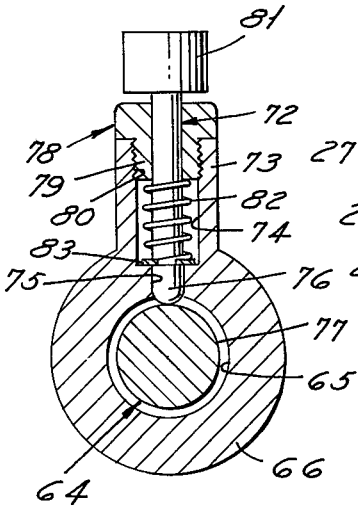
FIG. 6 is a fragmentary, enlarged, elevation section view of the structure illustrated in FIG. 1, taken along the line 6—6 thereof, and looking in the direction of the arrows.

As best seen in FIG. 6, the guide shaft supporting hub 66 is provided with an upwardly extended, integral housing 73 in which is formed a cylindrical chamber 74. The chamber 74 communicates with the bore 65 formed through the hub 66 by a reduced diameter bore 75. The spring-biased plunger 72 is mounted in the housing chamber 74, and the lower end thereof 76 extends through the bore 75 and into locking engagement with one of a plurality of recesses 77 formed in the outer periphery of the guide shaft 64. The plunger 72 is retained in the chamber 74 by a cap screw, generally indicated by the numeral 78. The cap screw 78 has a reduced diameter portion 79 which is threadably mounted in the upper open end 80 of the chamber 74. The plunger 72 has an enlarged head 81 which functions as a lift handle or knob for pulling the plunger 72 upwardly, as shown in FIG. 6, to release the plunger end 76 from a retainer recess 77 in the guide shaft 64. The plunger 72 is provided with a normally inwardly directed bias by a spring 82. The spring 82 is positioned in the chamber 74, about the plunger 72, with its upper end abutting the inner end of the cap screw portion 79 and its lower end in engagement with a washer 83 that is mounted about the plunger 72 and retained thereon by any suitable means. It will be seen that the spring 82 maintains a normal inwardly directed bias on the washer 83. It will be seen from FIG. 1 that the guide shaft 64 can be adjusted as desired relative to the body portion of the tape dispenser 10 by the last described operation of the spring-biased plunger 72 cooperating with the recesses 77 on the shaft 64. The peripheral recesses 77 may be spaced apart at any desired distance, as for example, 1. It will also be understood that the number of recesses 77 may be selected as desired.

As shown in FIG. 1, a guide means, generally indicated by the numerals 85, is releasably mounted on each of the free ends of the guide rod 64. As shown in FIG. 1, the guide means 84 includes an arcuate arm which has a centrally mounted hub 87 provided with an axial bore 88 which is also extended through the gide arm 86. One end of the guide shaft 64 is slidably mounted in the bore 88 and it is secured therein by a suitable thumb screw 89. The thumb screw 89 is threadably mounted in a threaded bore in the hub 87 and it has its inner end engaged in the outermost peripheral recess 77 on the adjacent end of the guide shaft 64. As shown in FIG. 2, the arcuate guide arm 86 is provided on the front side thereof, on each end thereof, with a recessed area 90 in which is operatively mounted a guide wheel or roller 91. Each of the guide rollers 91 is rotatably mounted in its respective recess 90 by a suitable cap screw 92 which is threadably mounted in the guide arm 86. As shown in FIG. 1, the rollers 91 are adapted to extend sidewardly outward from the guide arm 86 and to roll against a window pane supporting frame as for example, the window side frame 12. As shown in FIG. 2, the guide arm 86 is provided on its front side with a pair of integral projections 93 which are rounded on their outer faces and which are adapted to slide on the surface of a window pane, as for example, the window pane 11 of FIGS. 1 and 2, during a tape or foil applying operation.

Figure 9:
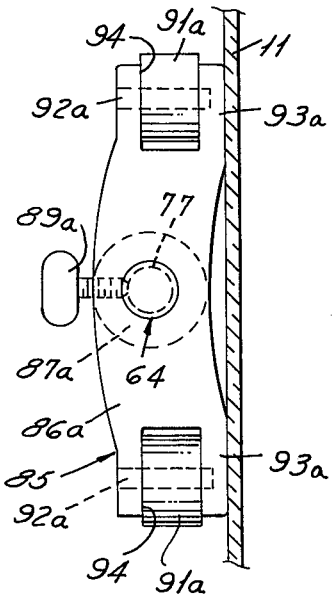
FIG. 9 is a right side elevation view of the tape dispenser illustrated in FIG. 1, taken along the line 9—9 thereof, and looking in the direction of the arrows.

The guide means 85 is shown in FIGS. 1 and 9 and the parts thereof which are the same as the parts of the guide means 84 have been marked with the same reference numerals followed by the small letter *a*. As shown in FIG. 9, the rollers 91*a* are mounted in recesses in the ends of the arcuate guide arm 86*a* instead of in a recess on the front side thereof so that the guide means 85 may be employed in lieu of the guide means 84 on the left side of the tape dispenser 10, as viewed in FIG. 1, when the tape dispenser 10 is being used on a window or door wherein the frame 12 is a wide frame or is of a construction wherein the rollers 91 will not functon properly. The projections 93*a* are adapted for sliding engagement with the window pane 11 and they each have a flat face. It will be seen that the guide means 84 and 85 are interchangeable with each other, depending upon the construction of the window or door frame, as the frame 12, against which the guide rollers are to be positioned.

Figure 10:
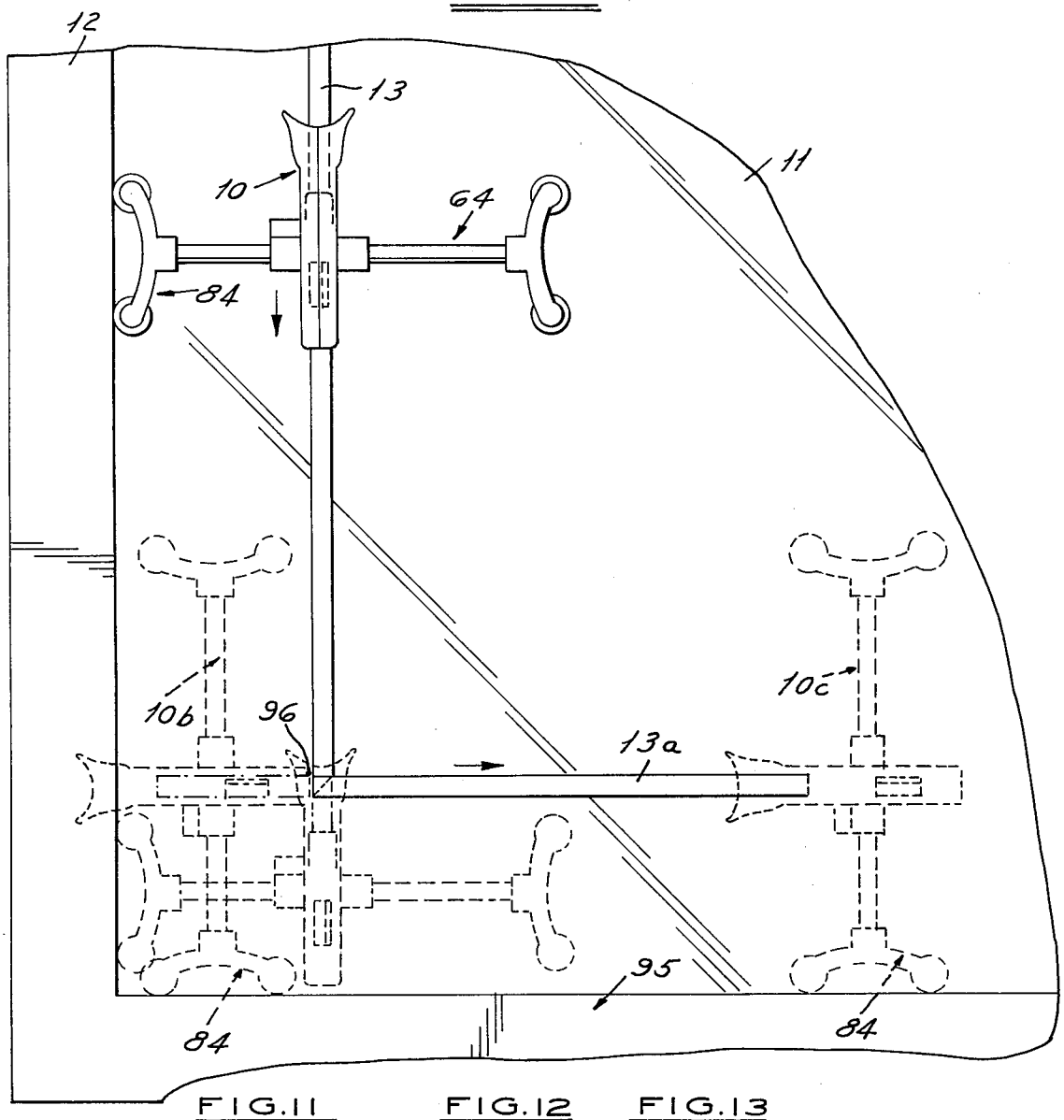
FIG. 10 is a fragmentary, elevation view of a window, and illustrating the operation of the tape dispenser of the present invention.

In use, the guide means 84 and 85 are initially mounted on the guide shaft 64 in any desired position. The spring loaded plunger 72 is pulled outwardly to permit the guide shaft 64 to be adjusted laterally in accordance with the one inch increment spacing of the peripheral recesses 77, so as to position the tape dispenser 10 on the guide shaft 64 at a predetermined positon to space the tape 13 from the window frame 12 the desired distance or margin, as illustrated in FIG. 10. The guide means 84 or 85 would be positioned to the left, as viewed in FIG. 10, in accordance with the structure of the window frame 12 so as to make use of the guide rollers 91 or 91*a*. With the dispenser 10 in the vertical position, and the guide means 84 in engagement with the lower window frame 95, the operator makes a reference mark 96, as in FIG. 10, at the approximate starting point for the horizontal straight run, using the upper edge of the foam extension pad 62 as a guide.

Referring to FIG. 2, and assuming that the window pane 11 is dry, the tape dispenser 10 is positioned as shown in solid lines in FIG. 10, for a vertical run. The operator starts the tape 13 at the starting mark at the upper end of the window pane 11 and then moves the dispenser 10 downwardly while at the same time pressing the tape 13 against the window pane 11 by means of the pressure pad 53 which has a 45° tapered or angled pressure face 55.

Figure 5:
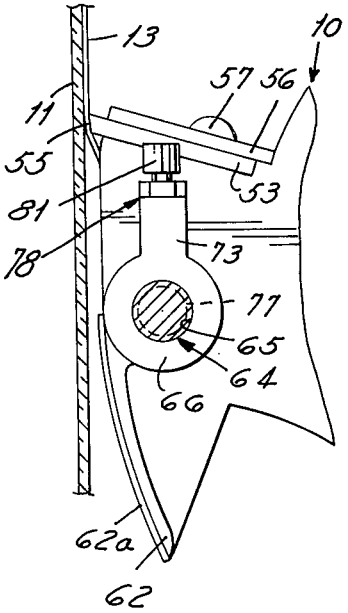
FIG. 5 is a fragmentary, elevation view, partly section, of the structure illustrated in FIG. 1, taken along the line 5—5 thereof, and looking in the direction of the arrows.

FIGS. 2, 3 and 5 show feeding of the tape or foil 13 from the dispenser 10 while being pressed on the window pane 11 as the dispenser 10 is moved vertically downward. FIG. 10 illustrates the applying of the tape or foil 13 over a vertical run. When starting a foil applying operation, a desired amount of foil 13 is allowed at the starting mark for the purpose of making a connection to the rest of the electrical alarm circuit. The dispenser 10 is moved downwardly to the broken line position indicated by the numeral 10*a*, at which point it is adjacent to the lower window frame designated by the numeral 95. The tape or foil 13 automatically feeds out of the dispenser 10 as it is moved over a glass pane 11, and the guide rollers on the guide means 84 guides the dispenser 10 in a straight line so as to permit the operator to hold a straight margin as the tape 13 is applied to the pane 11.

Figure 11:
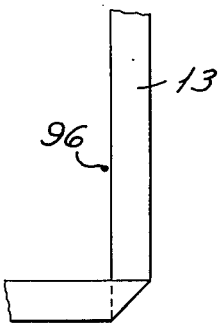
FIGS. 11 through 13 illustrate the steps that are carried out when using the tape dispenser of the present invenion to make a right turn in a tape dispensing operation.
Figure 12:
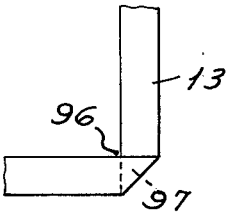

FIGS. 10 through 14 illustrate the making of a right angle turn with the dispenser tool 10. After the dispenser 10 has been moved to the broken line position marked with the numeral 10*a* in FIG. 10 (approximately 1 ¼ to 2 ¼ past mark 96 previously applied), the operator lifts the dispenser 10 from the window slightly. The dispenser tool 10 is then turned in place, to the vertical position, on its present axis. At this position, the tape 13 has formed a loose bend by means of restriction between guide member 52 and guide pin 61, which are shown in FIG. 3. The dispenser 10 with guide means 84 in engagement with the lower window frame 95 is moved forward, or to the left, as viewed in FIG. 10, to the position 10*b*. This operation allows the adhered extra tape 13 below the mark 96 to peel off the window and be moved to the left, as viewed in FIG. 10. The extra adhered tape 13 recedes up the window, forming a sharp 45° bend, as seen in FIG. 11. When the position of FIG. 12 is reached the tape 13 centers itself under the foam padded cushion 62*a*. The operator then presses downwardly to make a sharp crease at the overlapped point 97, as shown in FIG. 12. This position would approximate point 96, FIGS. 11 through 13. Upon familiarization with the operation of the dispenser tool 10, the use of the point 96 should not be neccessary, because the operator can approximate the point 96 without actually marking it.

Figure 13:
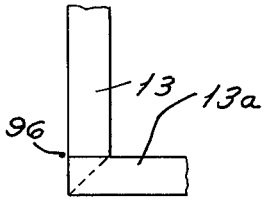

The dispenser 10 is moved from positon 10*b* shown in FIG. 10 to the right of the vertical run of tape 13 so as to fold back or pull the aforementioned free length of tape over the first overlapped portion 97, to a position shown in FIG. 13. At this point the operator presses the adhesive surface of the tape 13 against the window pane 11 with his free thumb, and the dispenser tool 10 is then moved to the right, as indicated in FIG. 10 by the numeral 10*c*, with the guide means 84 in engagement with the lower window frame 95 so as to continue the application of the tape or foil 13 on the window pane 11 to make a horizontal run of said tape, as indicated by the numeral 13*a* in FIGS. 10 and 14. Another right angle turn may then be made at the end of the horizontal tape 13*a* so as to continue the run upwardly and vertically along the other side of the window pane 11 and to a desired termination point. In instances where the window pane 11 is cold or damp, the self-adhesive tape or foil 13 may not adhere to the window pane 11. In such cases the path of the desired run of tape 13 is first coated with varnish, and the tape 13 is applied on the varnish after it has become tacky. A second wider coating of varnish is applied over the tape 13 to seal the tape and prevent moisture from getting underneath the tape. Coating the tape 13 with varnish also prevents persons from picking at the tape with their fingernails and damaging the tape so as to break the alarm circuit.

In order to apply a strip of varnish to a window pane 11, the varnish bottle 26 is attached to the dispenser 10 by the spring clip means 27. Rotating of the varnish bottle 26 positions the dauber 33 so as to apply a strip of varnish substantially equal to the width of the tape 13. FIG. 4 illustrates the application of a base strip of varnish 35. The tape 13 is coated with varnish in the same manner, but with the bottle 26 turned 90° so as to apply a wider strip of varnish 36 over the tape 13. The varnish is forced out of the bottle 26 and through the dauber 33 by a slight thumb pressure on the flexible bottle 26.

The tape dispenser 10 is adapted to hold a roll of electrically conductive foil of approximately 300 feet in length. Accordingly, it will be seen that the tape dispenser 10 has a foil capacity for an average foiling job. It will be seen that the tape dispenser 10 of the present invention is a time saver for persons installing an electrically conductive foil on window panes and the like, as compared to installing such tape in accordance with the prior art methods. With the tape dispenser 10, an installer can commence applying the foil 13 to a window without the necessity of lay-out work as is required by the prior art method of applying the tape by hand and using a tape which is rolled with a liner material.

The tape dispenser 10 of the present invention is best suited for self adhesive tapes which have adhesive on one side of the tape, whereby the tape or foil is kept from unravelling in the dispenser when right angle corners are formed, and so that the tape is not inadvertently unrolled from the dispenser.

While it will be apparent that the preferred embodiments of the invention herein disclosed is well calculated to fulfill the objects above stated, it will be appreciated that the invention is susceptible to modification, variation and charge.

What is claimed is:

1. In a tape dispenser capable of applying and sealing electricaly conductive tape in an unbroken application on a flat surface along straight paths around the perimeter of the surface, the combination, comprising:

a. a housing having a tape storage chamber, including a tape roll supporting means for rotatably supporting a roll of tape in said chamber;

b. a roll of tape rotatably mounted on said tape roll supporting means;

c. said housing having an extension on the front side thereof through which is formed a tape dispensing path, and which extension has on its outer face a tape discharge opening for discharging the tape from the housing and applying it to a flat surface;

d. a pressure means operatively carried on said housing extension in a position above said opening for pressing said tape on a flat surface as it is discharged from the housing extension opening; and, e. guide means adjustably carried by said housing extension for guiding the dispenser over a flat surface along a predetermined course including straight paths at right angles to each other;

f. an arcute padded pressure means carried on the lower front face edge of the housing extension capable of positioning the tape so as to complete a right angle turn while holding the same margin around the perimeter of the surface when making right angled turns in applying the tape on a flat surface.

2. A tape dispenser as defined in claim 1, wherein:

a. said pressure means carried on said housing extension in a positon above said opening includes an adjustable, removable pressure member having a tapered face for pressing engagement with the tape as it is discharged from said housing extension for pressing the tape on a flat surface.

3. In a tape dispenser for applying tape on a flat surface, the combination, comprising:

a. a housing having a tape storage chamber, including a tape roll supporting means for rotatably supporting a roll of tape in said chamber;

b. a roll of tape rotatably mounted on said tape roll supporting means;

c. said housing having an extension on the front side thereof through which is formed a tape dispensing path, and which extension has on its outer face a tape discharge opening for discharging the tape from the housing and applying it to a flat surface;

d. a pressure means operatively carried on said housing extension in a positon above said opening for pressing said tape on a flat surface as it is discharged from the housing extension opening;

e. guide means adjustably carried by said housing extension for guiding the dispenser over a flat surface along a predetermind course; and, f. said guide means including an elongated guide shaft adjustably mounted through said housing extension and having detachably mounted on each end thereof a roller guide means for rolling engagement with at least one guide member disposed adjacent the flat surface on which the tape is being dispensed for guiding the dispenser in a straight line.

4. A tape dispenser as defined in claim 3, wherein:

a. said roller guide means is disposed at right angles to the flat surface on which the tape is being dispensed.

5. A tape dispenser as defined in claim 3, wherein:

a. each of said roller guide means is provided with a sliding guide means for slidable engagement with the flat surface on which the tape is applied by the tape dispenser.

6. A tape dispenser as defined in claim 3, wherein:

a. said elongated guide shaft is provided with a plurality of recesses disposed at predetermined increments along the length thereof; and, b. a spring operated plunger is operatively mounted on said housing extension for operative engagement with the recesses in said elongated guide shaft to hold the shaft in a selected adjusted positon relative to the housing extension.

7. In a tape dispenser for applying tape on a flat surface, the combination, comprising:

a. a housing having a tape storage chamber, including a tape roll supporting means for rotatably supporting a roll of tape in said chamber;

b. a roll of tape rotatably mounted on said tape roll supporting means;

c. said housing having an extension on the front side thereof through which is formed a tape dispensing path, and which extension has on its outer face a tape discharge opening for discharging the tape from the housing and applying it to a flat surface;

d. a pressure means operatively carried on said housing extension in a position above said opening for pressing said tape on a flat surface as it is discharged from the housing extension opening;

e. guide means adjustably carried by said housing extension for guiding the dispenser over a flat surface along a predetermined course;

f. a varnish container support means mounted on the upper side of said housing;

g. a varnish container mounted on said support means;

h. a retainer means for retaining said varnish container on said support means; and, i. said varnish container being provided with a dauber for dispensing varnish on a flat surface as the dispenser is moved over the same to make a predetermined width strip of varnish on said surface for the reception of tape to hold the tape in place on said surface.

* * * * *

UNITED STATES PATENT OFFICE
CERTIFICATE OF CORRECTION

Patent No. 4,026,757 Dated May 31, 1977

Inventor(s) HARRY J. CRAWFORD

It is certified that error appears in the above-identified patent and that said Letters Patent are hereby corrected as shown below:

Column 1, line 12 - between "foil" and "windows" insert -- to --; line 14, "mehtods" should be -- methods --; line 39, "or" should be -- of --; line 62, "futher" should be -- further --.

Column 2, line 23, between "partly" and "sec-" insert -- in --, line 58, "aplying" should be -- applying --.

Column 3, line 20, "ad" should be -- and --.

Column 4, line 9, "te" should be -- the --, lines 14 and 15, delete -- ex-tended wall --.

Column 5, line 2, "fIG" should be -- FIG --, line 55, after "numerals" insert -- 84 and --, line 57, after "arm" insert -- 86 --.

Column 7, line 14, after "2 1/4" insert -- " --.

Column 8, line 36, claim 1 preamble, "electricaly" should be -- electrically --.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*